United States Patent [19]

Cartesse et al.

[11] Patent Number: 4,975,085

[45] Date of Patent: Dec. 4, 1990

[54] HOUSING FOR ARMORED CONNECTOR

[75] Inventors: Georges Cartesse, Le Blanc Mesnil; Armel Baldyrou, Houilles, both of France

[73] Assignee: Societe Anonyme dite: Radiall, Rosny-sous-Bois, France

[21] Appl. No.: 401,985

[22] Filed: Sep. 1, 1989

[30] Foreign Application Priority Data

Sep. 5, 1988 [FR] France ..... 88 11589

[51] Int. Cl.[5] ..... H01R 13/648

[52] U.S. Cl. ..... 439/609; 439/827; 439/924

[58] Field of Search ..... 439/92, 93, 94, 96, 439/108, 497, 607, 608, 609, 610, 827, 924

[56] References Cited

U.S. PATENT DOCUMENTS

| | | | |
|---|---|---|---|
| 3,609,632 | 9/1971 | Vetter | 439/609 X |
| 4,120,557 | 10/1978 | Horrocks | 439/827 |
| 4,456,325 | 6/1984 | Benz | 439/827 X |
| 4,808,126 | 2/1989 | Wilson | 439/607 |

FOREIGN PATENT DOCUMENTS

| | | |
|---|---|---|
| 0152748 | 8/1925 | European Pat. Off. . |
| 0147260 | 7/1985 | European Pat. Off. . |

*Primary Examiner*—Neil Abrams
*Assistant Examiner*—Khiem Nguyen
*Attorney, Agent, or Firm*—Schweitzer & Cornman

[57] ABSTRACT

A housing for an armored connector, in which one of the elements of the housing comprises, on its periphery, a number of thin, elastic contact blades electrically connected with one another, as well as with the housing element which carries them, these contact blades coming to rest against the other housing element at the time of connection, characterized in that each contact blade extends essentially in the direction of the relative movement of the two elements of the housing at the time of connection and is comprised of a thin metal blade bent back in the shape of a U, the free end of which rest against the housing element which carries it, in such a way as to push elastically against the outside of the utility part of the contact blade upon contact with the said other housing element, the said contact blades being connected to a counterplate which ensures that they are securely attached to the housing element.

9 Claims, 3 Drawing Sheets

HOUSING FOR ARMORED CONNECTOR

BACKGROUND OF THE INVENTION

The present invention relates to a housing for an armored connector.

It is known that several electrical connector elements can be grouped together in a housing comprising a male and a female element which engage into one another while guiding the various connector elements at the time they engage.

In numerous cases, it is necessary to armor not only the wires which are connected, but also the connector housings themselves.

For this purpose, the housings are made of a material which conducts electricity, for example a metal, but it is necessary to ensure electrical continuity between the two elements of the housing, and to do this in such a way that at the time of connection, the first electrical contact occurs at the level of the armoring, and not at the level of one of the connected conductors.

The present invention intends to resolve these problems in a simple, reliable and economical manner.

SUMMARY OF THE INVNENTION

The present invention has as its object a housing for an armored connector, in which one of the elements of the housing comprises, on its periphery, a number of thin, elastic contact blades electrically connected with one another, as well as with the housing element which carries them, these contact blades coming to rest against the other housing element at the time of connection, characterized by the fact that each contact blade extends essentially in the direction of the relative movement of the two elements of the housing at the time of connection and is comprised of a thin metal blade bent in the shape of a U, the free end of which rests against the housing element which carries it in such a way as to push elastically against the outside of the utility part of the contact blade upon contact with the said other housing element, the said contact blades being connected to a counterplate which ensures that they are securely attached to the housing element.

According to a preferred embodiment of the invention, the contact blades are made of a metal band, the central, continuous part of which is attached to the counterplate by clipping, soldering, gluing or setting.

In a preferred embodiment of the invention, the contact blades are connected with a counterplate provided with openings which allow the contact blades to pass through. Preferably, the bent part of the contact blades comprises lateral extensions which extend beyond the openings of the counterplate, in order to prevent the contact blades from moving away from the housing element to which they are attached, and to do this in such a way that they cannot be displaced unless a force exceeding a predetermined value is exerted on them, this value being determined by the contact pressure.

In a preferred embodiment of the invention, the contact blades and the counterplate are provided with centering means in order to position the contact blades correctly relative to the counterplate.

According to a preferred embodiment of the invention, the contact blades are double, one directed in the direction of the connection movement, the other directed in the opposite direction, in such a way as to establish two contacts, simultaneous or successive, on a single generator.

In a preferred variation of the invention, the contact blades have a transverse profile which is slightly convex in the zone where they enter into contact with the housing element to which they are not attached.

It is evident that thanks to the invention, it is possible to easily achieve efficient armoring of housings for connectors, where the elastic contact blades can be made along continuous bands which are then shaped and attached to the housing elements. The same holds true for the counterplates.

In order to make the invention more easily understood, an embodiment taken as an example and shown on the attached drawing will now be described, as an illustration and without any limiting character whatsoever.

DESCRIPTION OF THE DRAWINGS

FIG. 1 shows a schematic view of a housing for a connector, comprising a male element 1 which engages in known manner with a female element 2, while the male contacts 3, connected with conductors which are not shown, engage wih the female contacts 4, connected with corresponding conductors which are also not shown.

Figure 1:
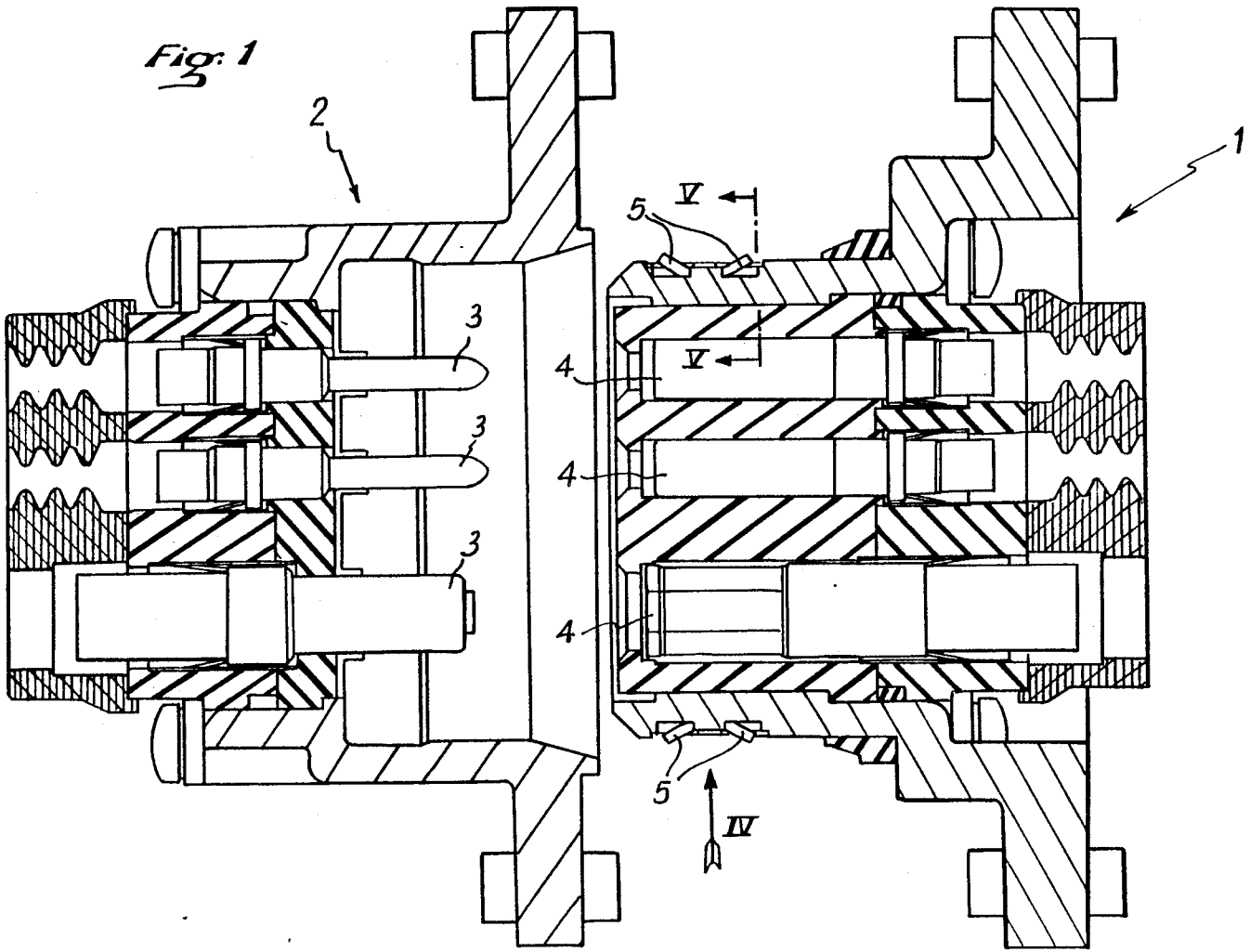
FIG. 1 is a schematic view of a housing for an armored connector according to the invention.

In the embodiment shown in FIG. 1, elastic contact blades 5 which assure electrical connection between the two elements 1 and 2 of the housing are arranged on the external periphery of the male element, but in a variation, they could be arranged on the internal periphery of the female element.

In FGIS. 2, 3 and 4, the elements which make it possible to implement armoring of the housing according to the invention are shown on a larger scale.

FGIS. 2 and 3 show the opening of the female element 2 which comprises a conical, bell-shaped part **2*a* in the vicinity of its end, followed by a first straight part 2*b* and a second straight part 2*c*** with a larger dimension, forming a recess in the vicinity of its internal end.

The male element 1 has at its end a bevel **1*a*** intended to facilitate centering of the two housing elements while they are being connected.

On its periphery, the male element presents a groove 6, with a small depth, the width of which is slightly greater than the width of a counterplate 7 which holds the contact blades.

The male element 1 also comprises two recesses 8, placed at the bottom of the groove 6 and intended to hold the bent-back ends **5*a* if the contact blades 5**.

Figure 2:
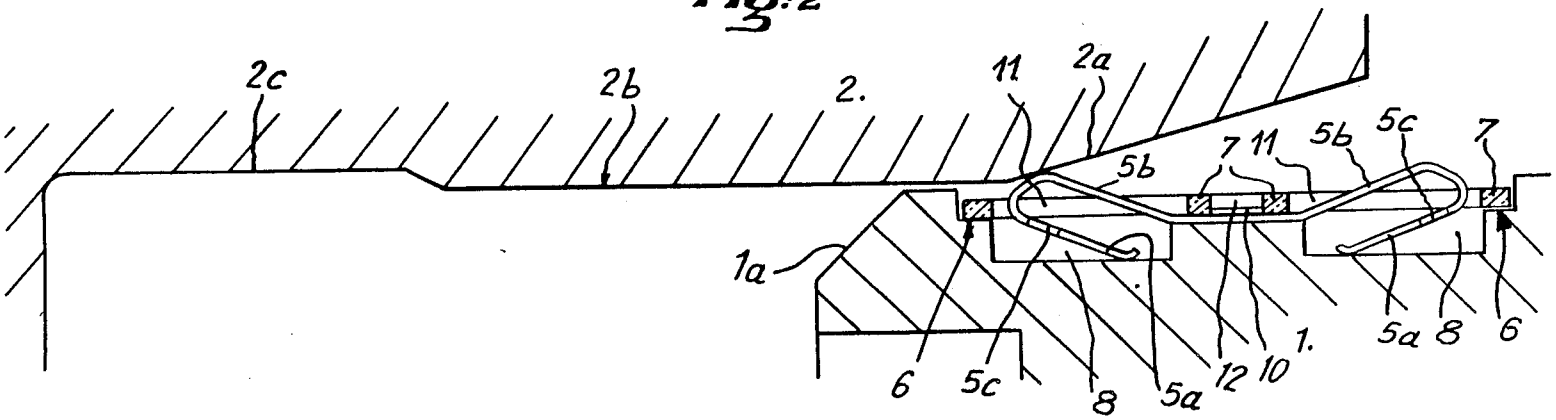
FIG. 2 and 3 are views, on a larger scale, of the housing elements which carry the armoring contact blades according to the invention, the former at the start of the connection movement and the latter at the end of the connection movement.
Figure 4:
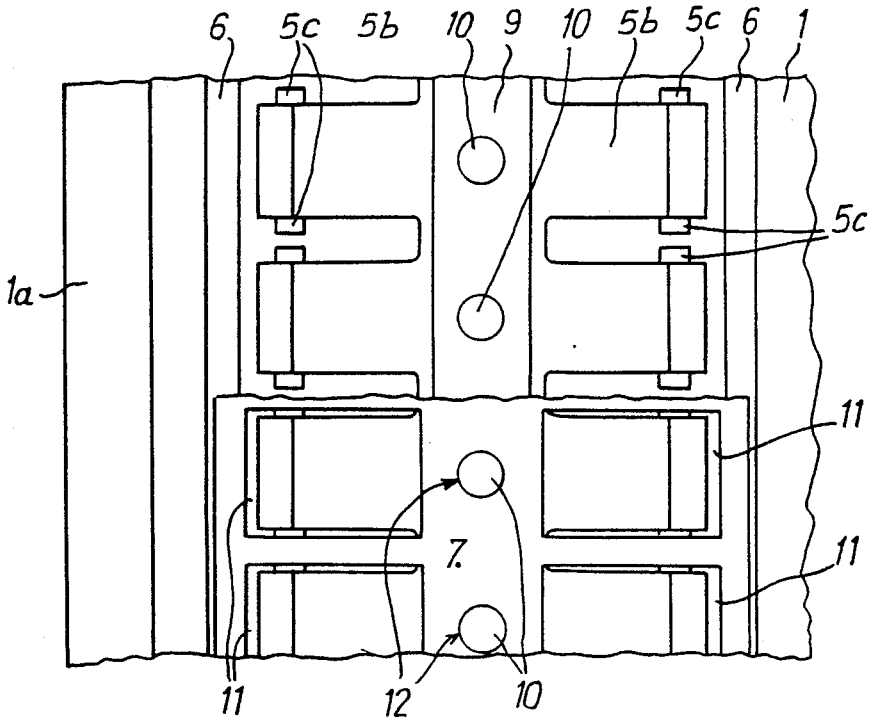
FIG. 4 is a top view with partial cut-away of the counterplate along the arrow 4 of FIG. 1.

FIG. 4, which is a top view with partial cut-away of the armoring device, along the arrow IV of FIG. 1 or according to a top view of the male element such as it is shown in FIG. 2, shows the bevel **1*a* of element 1 as well as the groove 6**.

Figure 3:
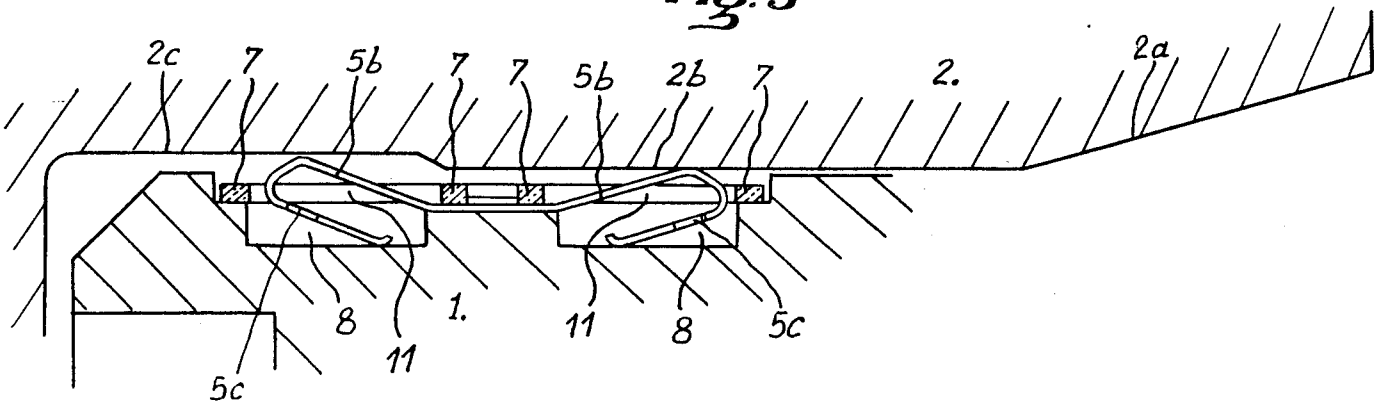

On this figure, the upper part 5b of the contact blades which are bent back towards the bottomn at 5a, as they are clearly evident on FIGS. 2 and 3, can also be seen.

FIG. 4 also shows how the two series of contact blades 5 are connected with one another by a continuous band 9 provided with embossments 10 intended for positioning of the contact blades relative to the counterplate 7, as will be explained below.

The lower, bent-back parts 5a of the contact blades are provided with lateral extensions 5c, which work together with the counterplate 7 to limit the displacement of the contact blades toward the outside, as will be explained in the following.

The counterplate 7, which can be made of a material which conducts electricity or of an insulating material, presents itself in the form of a rectangular band, the lateral edges of which come to rest against the bottom of the groove 6 and which is provided with windows 11, the size of which is slightly greater than the width of the contact blades 5b, but less than the width of the contact baldes 5b plus the height of the lateral extensions 5c.

The counterplates 7 are also provided with circular recesses 12 into which the embossments 10 engage, which makes it possible to ensure exact positioning of the contact blades relative to the counterplate 7.

In accordance with the invention, the counterplate 7 positioned in this way can be firmly attached to the central band 7 which carries the contact blades, by setting, clipping, soldering or gluing.

The assembly obtained in this way can be cut to the desired length, and shaped in such a way that it can be applied along the entire periphery of the male element, engaging the counterplate 7 in the groove 6.

In the embodiment presented, it is clear that the central part of the groove 6, situated between the recesses 8, has a height which is slightly less, to allow positioning of the central band 9 which carries the contact blades.

The assembly comprised of the counterplate 9 and the contact blades can be attached to the male element of the housing by setting, clipping, soldering or gluing, for example.

In another variation, the ends of the counterplate 7 can be soldered, clipped or glued only to each other, to make the assembly of the counterplate 7 and the contact blades into one piece with the housing element, without this assembly requiring any attachment to the latter.

Figure 5:
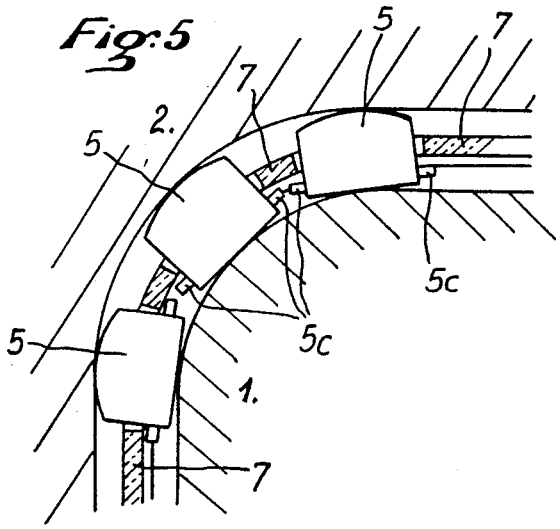
FIG. 5 is a cross-sectional view, on a larger scale, along Line V—V of FIG. 1, after connection.

As can be clearly seen in FIG. 5, the assembly comprised of the counterplate 7 and the contact blades can be easily bent back, to go around the housing element, where the contact blades 5 with their lateral extensions 5c can be seen again, along with the counterplate 7 which is shown in cross-section.

FIGS. 2 and 3 show two phases of connection.

FIG. corresponds to the moment when the left contact blade comes into contact with the opening 2a, in the shape of a truncated cone, of the female element of the housing.

At this moment, the contact blade is pushed upward by the fact that its bent-back end 5a comes to rest against the bottom of the recess 8, while the lateral extensions 5c come to rest against the counterplate 7.

In this manner, the left contact blade 5 is subjected to a constraint, so that it is necessary to exert a certain force in order to push it towards the bottom.

This force is exerted when the male element is engaged farther forward into the female element, the upper part of the contact blade being then pushed back by the conical surface 2a.

In this way, multiple electrical contacts are established on the periphery of the housing elements, using the numerous contact blades located there, before the individual contacts 3, 4 have been placed into contact with one another.

While the male element continues to be pushed into the female element, the upper part of the left contact blades slides onto the right part 2b of the female element, the upper part of the right contact blades comes to rest on the conical surface 2a, creating a second electrical contact which takes place when the right and left contact blades simultaneously come to rest against the right part 2b.

At the end of engagement, as shown in FIG. 3, the left contact blades engage in the recess formed by the part 2c of the female element, which has a larger dimension, while continuous armoring is ensured by the right contact blades.

It is clear that it is not always necessary to make a second part 2c with a larger dimension, as in this particular embodiment, but it can often happen that this configuration of the female element is required by international standards.

As can be seen in FIG. 5, it is advantageous according to the invention that the part of the contact blades which comes into contact with the housing element which does not carry them should have a rounded transverse cross-section, both to ensure complete electrical contact and to allow it to be adapted to the curves of the housing, as can be seen in FIG. 5.

It is equally obvious that it is not absolutely necessary to have two contact blades, one located at the right, the other at the left, to the extent that the electrical contact established with the left contact blade is maintained during the entire connection movement.

One can see that thanks to the invention, it is possible to implement efficient armoring of connector housings, using a simple device which can be produced continuously in the form of bands, which can then be cut to size and adapted to the various shapes of connector housings.

It is, of course, understood that the embodiment which has been described above does not represent any limitation and that it can undergo any desirable modification, without thereby leaving the scope of the invention.

We claim:

1. A two element housing for an armored connector, in which one of the elements of the housing includes, on its periphery, a series of thin, resilient contact blades electrically connected with one another as well as with a first housing element which carries them, said contact blades engaging a second housing element upon connection of the two elements in a predetermined direction, characterized in that each contact blade extends essentially in said predetermined direction of the relative movement of the two elements of the housing for connection and is comprised of a thin metal U-shaped blade the free end of which engages the housing element which carries it in a manner to bias the contact blade outwardly toward the other housing element, said contact blades being mounted on a counterplate means which is securedly attached to the housing element and which provides protection for said blades, said counterplate means being wider than said blades.

2. A housing according to claim 1, characterized in that the contact blades are made of a metal band having a central continuous portion which is securely attached to the counterplate means by fastening means.

3. A housing according to claim 2, characterized in that the counterplate means is provided with a series of openings through which the contact blades extend.

4. A housing according to claim 3, characterized in that the bent, free ends of said contact blades include lateral extensions which project beyond the openings of the counterplate means to limit the movement of the contact blades from the first housing element to which they are attached to accommodate change in blade shape only upon application of a force exceeding a predetermined value determined by contact pressure.

5. A housing according to claim 4, characterized in that the contact blades and the counterplate means are provided with centering means to position them in a predetermined relation to one another.

6. A housing according to claim 5, characterized in that the counterplate means is securely attached to the housing element by fastening means.

7. A two element housing for an armored connector, in which one of the elements of the housing includes, on its periphery, a series of thin, double acting resilient contact blades electrically connected with one another as well as with a first housing element which carries them, said contact blades engaging a second housing element upon connection of the two elements in a predetermined direction, characterized in that each contact blade has a first portion extending essentially in said predetermined direction of the relative movement of the two elements of the housing for connection and each contact blade having a second portion extending in the opposite direction; each blade is comprised of a thin metal U-shaped strip the free end of which engages the housing element which carries it in a manner to bias the contact blade outwardly toward the other housing element, said contact blades being mounted on a counterplate means which is securely attached to the housing element and which provides protection for said blades, said counterplate means being wider than said blades; said contact blades are made of a metal band having a central continuous portion which is securely attached to the counterplate means by fastening means; the counterplate means is provided with a series of openings through which the contact blades extend; the bent, free ends of said contact blades include lateral extensions which project beyond the openings of the counterplate means to limit the movement of the contact blades from the first housing element to which they are attached to accommodate change in blade shape only upon application of a force exceeding a predetermined value determined by contact pressure; the contact blades and the counterplate means are provided with centering means to position them in a predetermined relation to one another; and the counterplate means is securely attached to the housing element by fastening means.

8. A housing according to claim 7, characterized in that the contact blades have a transverse profile which is slightly convex in the zone where the blades engage the housing element to which they are not attached.

9. A housing according to claim 8, characterized in that the housing element includes a peripheral recess for receiving said counterplate means, and the ends of the counterplate means are fastened to one another in said recess to assemble the contact blades and the counterplate with the housing element.

* * * * *